US008574132B2

(12) United States Patent
VanElverdinghe et al.

(10) Patent No.: US 8,574,132 B2
(45) **Date of Patent: *Nov. 5, 2013**

(54) TRAMPOLINE WITH SLEEVE JOINT COUPLING

(75) Inventors: Jeffry L. VanElverdinghe, Beaverton, OR (US); Craig B. Adams, Portland, OR (US)

(73) Assignee: CA06, LLC, Addison, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/269,369

(22) Filed: Oct. 7, 2011

(65) Prior Publication Data

US 2012/0028763 A1 Feb. 2, 2012

Related U.S. Application Data

(63) Continuation of application No. 11/379,772, filed on Apr. 21, 2006, which is a continuation-in-part of application No. 10/908,469, filed on May 12, 2005, now Pat. No. 7,494,444, which is a continuation-in-part of application No. 10/905,105, filed on Dec. 15, 2004, now Pat. No. 7,927,254.

(60) Provisional application No. 60/530,054, filed on Dec. 16, 2003.

(51) Int. Cl.
*A63B 5/11* (2006.01)

(52) U.S. Cl.
USPC ..... 482/27

(58) Field of Classification Search
USPC ..... 482/27–29
See application file for complete search history.

(56) References Cited

U.S. PATENT DOCUMENTS

| | | | |
|---|---|---|---|
| 774,393 | A | 11/1904 | Palmer |
| 959,973 | A | 5/1910 | Tomkins |
| 1,488,244 | A | 10/1920 | Hinton |
| 1,830,262 | A | 11/1931 | Carlson |
| 1,850,049 | A | 3/1932 | Cornell, Jr. |
| 1,982,498 | A | 11/1934 | Cornell, Jr. |
| 1,992,312 | A | 2/1935 | Kuehn |
| 2,128,720 | A | 8/1938 | Tweedale |

(Continued)

FOREIGN PATENT DOCUMENTS

AU 2004100729 A4 9/2004

OTHER PUBLICATIONS

H176, Johnstone, Jr. "Slip Tee Pipe Fitting," Dec. 2, 1986.

(Continued)

*Primary Examiner* — Oren Ginsberg
(74) *Attorney, Agent, or Firm* — Thompson & Knight LLP; James J. Murphy

(57) ABSTRACT

A trampoline is disclosed that includes first, second, and third frame members, a pole member, and a sleeve joint coupling. The sleeve joint coupling includes a first arm with a first passage, a second arm with a second passage, a third arm extending away from the second arm and including a third passage, and an aperture. The first passage has a first axis, and the second and third passages shares a substantially common axis. The first axis is substantially perpendicular to the substantially common axis. The first frame member is received in the first passage, the second frame member is received in the second passage, the third frame member is received in the third passage, and the pole member is received in the aperture to extend away from the first frame member. At least one of the second and third arms defines an uppermost surface of the sleeve joint coupling.

18 Claims, 12 Drawing Sheets

(56) References Cited

U.S. PATENT DOCUMENTS

| | | | |
|---|---|---|---|
| 2,430,714 | A | 11/1947 | Geer |
| 2,858,551 | A | 11/1953 | Sidlinger |
| 2,809,383 | A | 10/1957 | Fenner et al. |
| 2,931,129 | A | 4/1960 | Boniface |
| 3,201,126 | A | 8/1965 | Nissen |
| 3,339,925 | A | 9/1967 | Nissen |
| 3,502,357 | A | 3/1970 | Wagner |
| 3,837,643 | A | 9/1974 | Lee |
| 3,988,872 | A | 11/1976 | Adamson et al. |
| 4,008,971 | A | 2/1977 | Wah et al. |
| 4,139,192 | A | 2/1979 | McNeil |
| 4,157,801 | A | 6/1979 | Elmer |
| RE30,344 | E | 7/1980 | McNeil |
| 4,284,271 | A | 8/1981 | Pettit et al. |
| 4,339,123 | A | 7/1982 | Rich |
| 4,359,851 | A | 11/1982 | Daniels |
| 4,370,790 | A | 2/1983 | Rodaway |
| 4,386,772 | A | 6/1983 | Wu |
| 4,413,361 | A | 11/1983 | Wolf et al. |
| 4,433,838 | A | 2/1984 | Gordon |
| 4,478,420 | A | 10/1984 | Sowards |
| 4,480,941 | A | 11/1984 | Gilb et al. |
| 4,514,107 | A | 4/1985 | Moreno |
| 4,540,309 | A | 9/1985 | Hansson |
| 4,569,515 | A | 2/1986 | Gordon |
| 4,572,695 | A | 2/1986 | Gilb et al. |
| 4,598,905 | A | 7/1986 | Vrana |
| 4,644,892 | A | 2/1987 | Fisher |
| 4,703,769 | A | 11/1987 | Harrison, Jr. |
| 4,776,581 | A | 10/1988 | Shepherdson |
| 4,836,530 | A | 6/1989 | Stanley, Jr. |
| 4,863,156 | A | 9/1989 | Shaw |
| 4,885,883 | A | 12/1989 | Wright |
| 4,900,011 | A | 2/1990 | Nolet |
| 5,010,603 | A | 4/1991 | Hertzog |
| 5,040,716 | A | 8/1991 | Stetz |
| D328,119 | S | 7/1992 | Matsch |
| D328,940 | S | 8/1992 | Matsch |
| D330,741 | S | 11/1992 | Matsch |
| D330,742 | S | 11/1992 | Matsch |
| D330,744 | S | 11/1992 | Matsch |
| 5,230,581 | A | 7/1993 | Deng |
| 5,269,533 | A | 12/1993 | Kellams |
| 5,299,839 | A | 4/1994 | Moravero |
| 5,364,313 | A | 11/1994 | Nickelson |
| 5,390,913 | A | 2/1995 | Kepler |
| 5,399,132 | A | 3/1995 | Bailey |
| 5,469,678 | A | 11/1995 | Zamerovsky |
| 5,545,110 | A | 8/1996 | Hsiang |
| 5,549,067 | A | 8/1996 | Jolin |
| 5,575,738 | A | 11/1996 | Millington et al. |
| D376,405 | S | 12/1996 | Strawcutter et al. |
| 5,590,974 | A | 1/1997 | Yang |
| 5,617,697 | A | 4/1997 | Erwin |
| D382,618 | S | 8/1997 | Gift |
| 5,664,769 | A | 9/1997 | Sadinsky et al. |
| 5,674,157 | A | 10/1997 | Wilkinson |
| 5,711,743 | A | 1/1998 | Nichols, Jr. et al. |
| 5,810,695 | A | 9/1998 | Sass |
| 5,833,557 | A | 11/1998 | Cole |
| 5,876,311 | A | 3/1999 | Coates et al. |
| 5,921,049 | A | 7/1999 | Sugiyama |
| 5,941,798 | A | 8/1999 | Coan et al. |
| 6,001,045 | A | 12/1999 | Gift et al. |
| 6,017,292 | A | 1/2000 | Gift et al. |
| 6,032,431 | A | 3/2000 | Sugiyama |
| 6,053,845 | A | 4/2000 | Publicover et al. |
| 6,110,074 | A | 8/2000 | Tacquet |
| 6,135,921 | A | 10/2000 | Holland et al. |
| 6,162,061 | A | 12/2000 | Taylor |
| 6,193,632 | B1 | 2/2001 | Steger |
| 6,216,717 | B1 | 4/2001 | Chen |
| 6,261,207 | B1 | 7/2001 | Publicover et al. |
| 6,319,174 | B1 | 11/2001 | Alexander |
| 6,402,414 | B1 | 6/2002 | Kanodia et al. |
| 6,402,662 | B1 | 6/2002 | Rieber |
| 6,413,004 | B1 | 7/2002 | Lin |
| 6,450,187 | B1 | 9/2002 | Lin et al. |
| 6,478,039 | B2 | 11/2002 | Suh |
| 6,607,468 | B1 | 8/2003 | Nichols, Jr. et al. |
| 6,742,202 | B2 | 6/2004 | Jones |
| 6,748,962 | B2 | 6/2004 | Miller |
| 6,802,169 | B2 | 10/2004 | Simmons |
| 6,846,271 | B2 | 1/2005 | Publicover |
| 7,182,713 | B2 | 2/2007 | Wang et al. |
| 7,241,072 | B2 | 7/2007 | Patrignani |
| 2002/0137598 | A1 | 9/2002 | Publicover et al. |
| 2003/0026645 | A1 | 2/2003 | Koke, Jr. |
| 2003/0036460 | A1 | 2/2003 | Publicover |
| 2003/0104905 | A1 | 6/2003 | Publicover |
| 2004/0091307 | A1 | 5/2004 | James |
| 2004/0121883 | A1 | 6/2004 | Publicover |
| 2004/0147370 | A1 | 7/2004 | Wang et al. |
| 2004/0171461 | A1 | 9/2004 | Alexander |
| 2004/0171462 | A1 | 9/2004 | Alexander |
| 2004/0176214 | A1 | 9/2004 | Yuch |
| 2005/0032609 | A1 | 2/2005 | Nissen et al. |
| 2005/0037896 | A1 | 2/2005 | Publicover |
| 2005/0084627 | A1 | 4/2005 | Alexander |
| 2005/0226683 | A1 | 10/2005 | Herb |

OTHER PUBLICATIONS

L.H. Teh et al., "Strength of Welded T-Joint Truss Connections Between Equal Width Cold-Formed RHS," Research Report No. R831, Dept. of Civil Engineering, Centre For Advanced Structural Engineering, The University of Sydney, Aug. 2003.

VIEW A

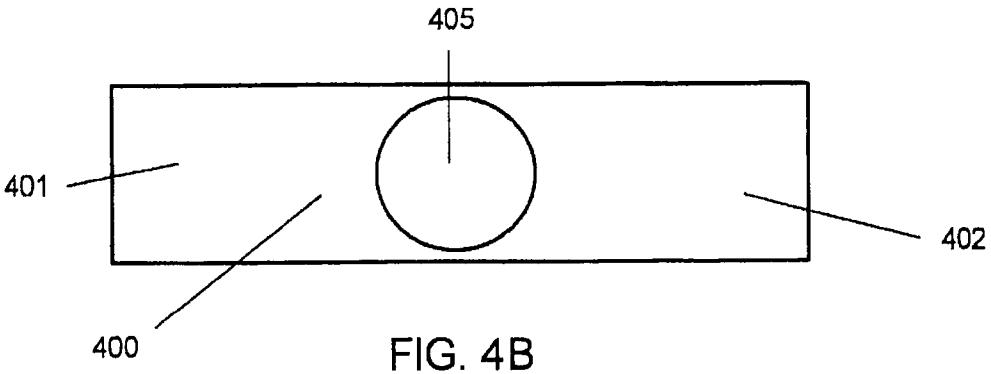
FIG. 4B
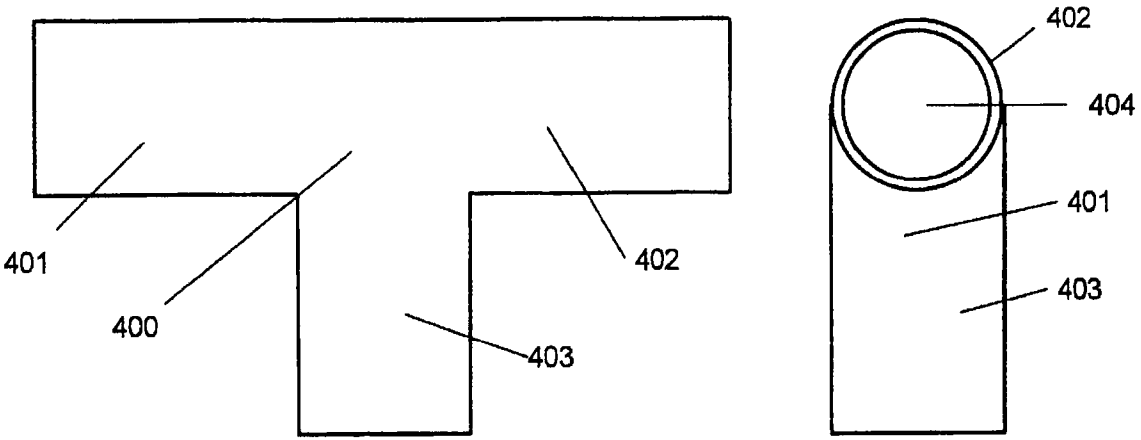
FIG. 4C
FIG. 4A

TRAMPOLINE WITH SLEEVE JOINT COUPLING

CROSS-REFERENCE TO RELATED APPLICATIONS

This application is a continuation of U.S. patent application Ser. No. 11/379,772, filed on Apr. 21, 2006, now U.S. Pat. No. 8,137,242, which is a continuation-in-part of U.S. patent application Ser. No. 10/908,469, filed May 12, 2005, now U.S. Pat. No. 7,494,444, which is a continuation-in-part of U.S. patent application Ser. No. 10/905,105, filed Dec. 15, 2004, now U.S. Pat. No. 7,927,254, which claims priority to U.S. Provisional Patent Application No. 60/530,054, filed Dec. 16, 2003. The entire disclosure of each of the above applications are incorporated herein by reference.

FIELD

The subject matter disclosed herein relates to trampolines and, more particularly, relates to a trampoline with a sleeve joint coupling.

BACKGROUND

This section provides background information related to the present disclosure which is not necessarily prior art.

Recreational structures having frames, such as trampolines, are well-known. For example, a trampoline has a horizontal frame to which a rebounding surface is attached and a plurality of vertical frame members, or legs, that support the horizontal frame and rebounding surface above the ground. While the horizontal and vertical frame portions of a trampoline could be fabricated to be one unitary structure, such a unitary structure is cumbersome when the trampoline frame is transported to a place where the trampoline is used. Accordingly, trampoline frames are typically formed from a plurality of pieces that are fastened together at the time a trampoline is assembled.

A desirable characteristic for all trampoline frames formed from a plurality of pieces is that the various pieces are attached or joined to each other using a technique that is simple, quick to assemble and is reliable.

SUMMARY

This section provides a general summary of the disclosure, and is not a comprehensive disclosure of its full scope or all of its features.

A trampoline is disclosed that includes a first frame member, a second frame member, a third frame member, a pole member, and a sleeve joint coupling that couples the first, second, and third frame members and the pole member. The sleeve joint coupling includes a first arm with a first passage, a second arm with a second passage, a third arm extending away from the second arm and including a third passage, and an aperture that terminates at a top rim. The first passage has a first axis, and the second and third passages shares a substantially common axis. The first axis is substantially perpendicular to the substantially common axis, and the first axis extends in a vertical direction. The first frame member is received in the first passage, the second frame member is received in the second passage, the third frame member is received in the third passage, and the pole member is received in the aperture to extend away from the first frame member. At least one of the second and third arms defines an uppermost surface of the sleeve joint coupling. The top rim of the aperture is either disposed substantially flush with the uppermost surface or disposed below the uppermost surface in the vertical direction.

Furthermore, a trampoline is disclosed that includes a first frame member, a second frame member, a third frame member, a pole member, and a sleeve joint coupling that couples the first, second, and third frame members and the pole member. The sleeve joint coupling includes a first arm with a first passage, a second arm with a second passage, a third arm extending away from the second arm and including a third passage, and an aperture. The first passage has a first axis, and the second and third passages share a substantially common axis. The first axis is substantially perpendicular to the substantially common axis. The first frame member is received in the first passage, the second frame member is received in the second passage, the third frame member is received in the third passage, and the pole member is received in the aperture to extend away from the first frame member. The first, second, and third arms are integrally connected such that the sleeve joint coupling is a single, monolithic part.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 depicts a perspective view of an exemplary trampoline having an exemplary safety enclosure;

FIGS. 2A-2C respectively show a side view, a top view and an end view of the first exemplary embodiment of a sleeve joint coupling for a trampoline frame according to the subject matter disclosed herein;

Figure 5C:
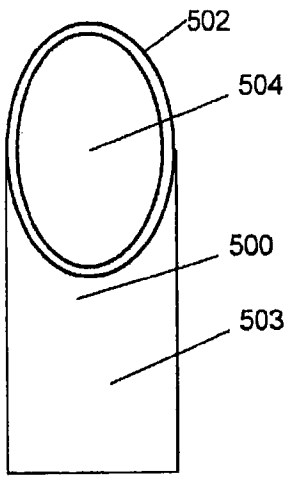
Figure 5B:
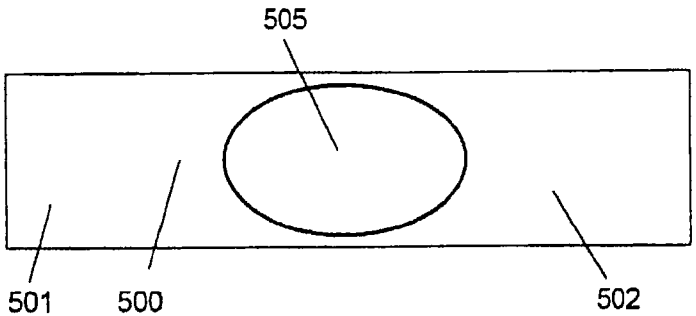
Figure 5A:
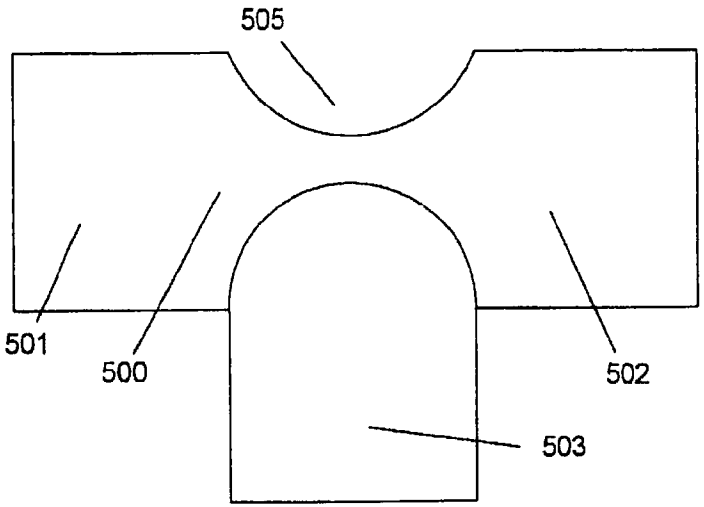
Figure 6B:
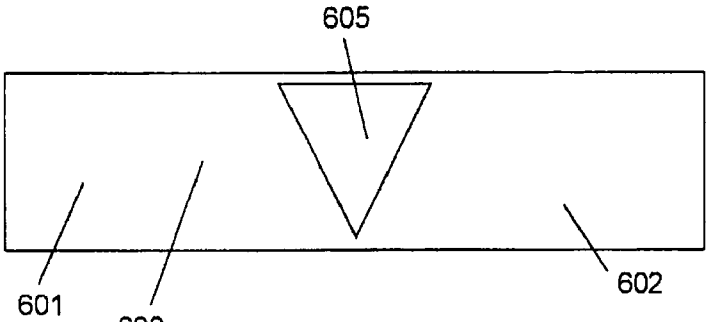
Figure 6A:
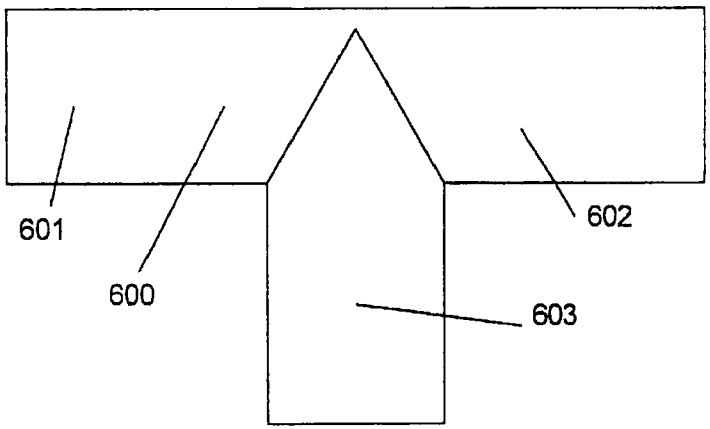
Figure 6C:
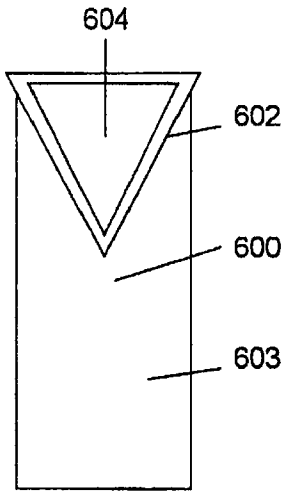
Figure 7B:
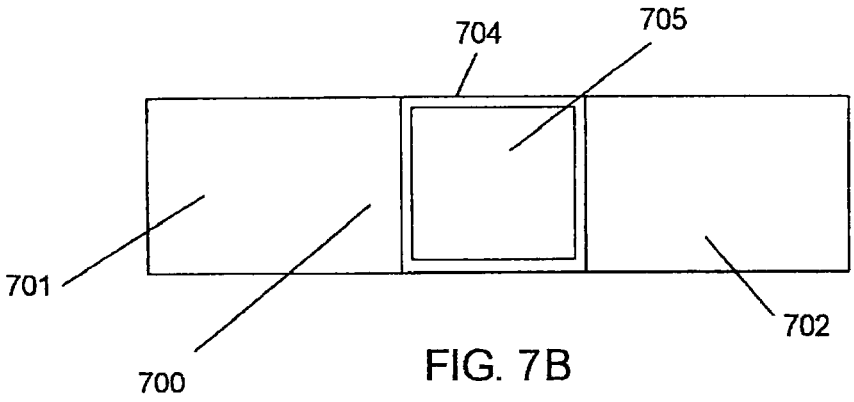
Figure 7A:
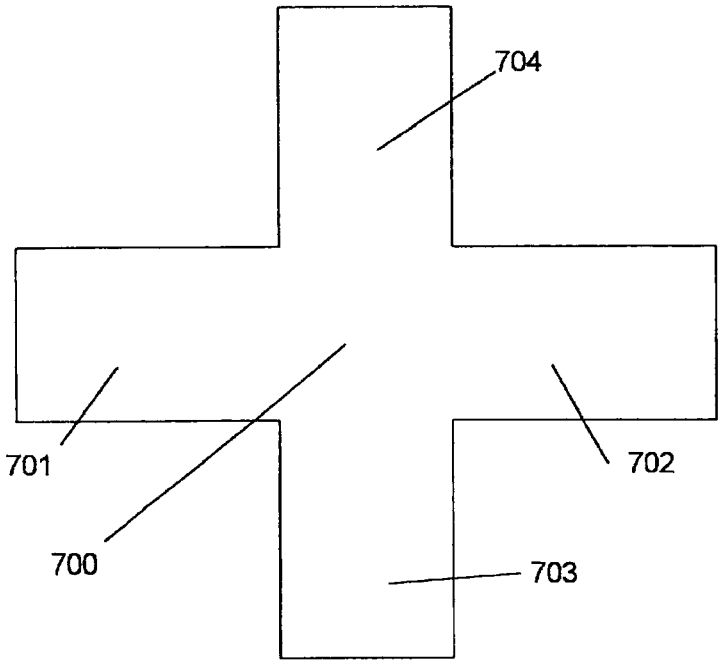
Figure 8C:
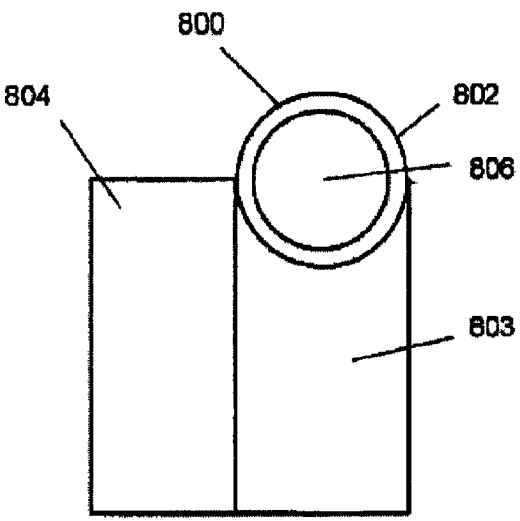
Figure 8B:
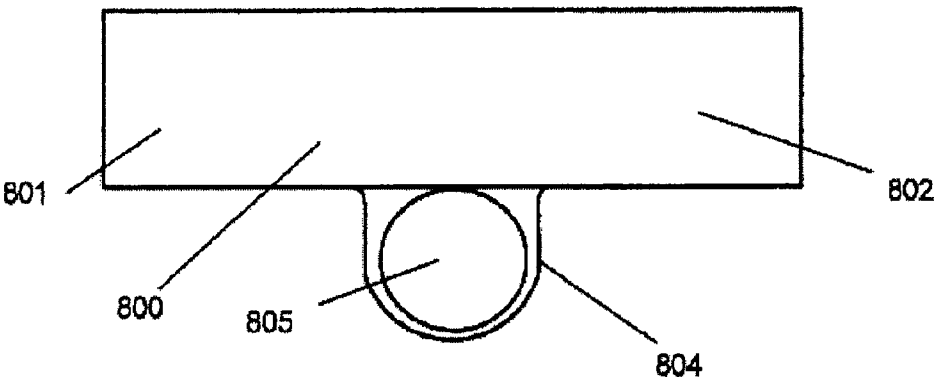
Figure 8A:
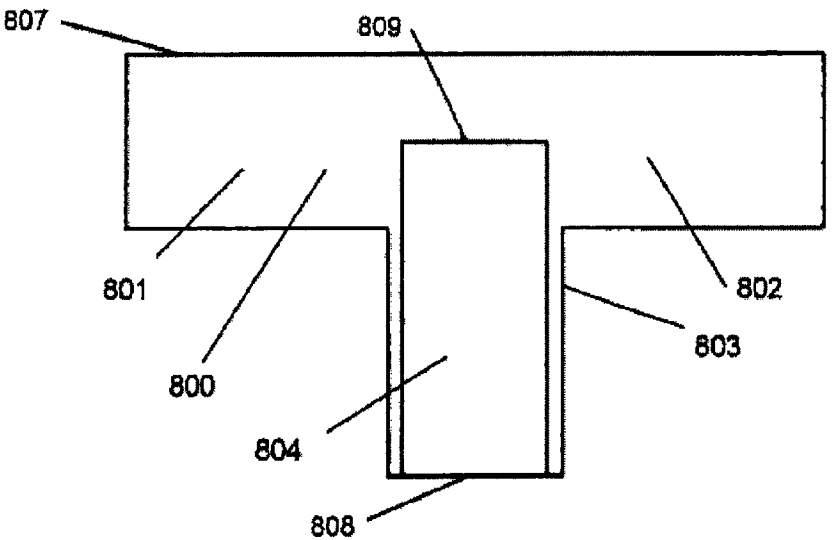
Figure 9C:
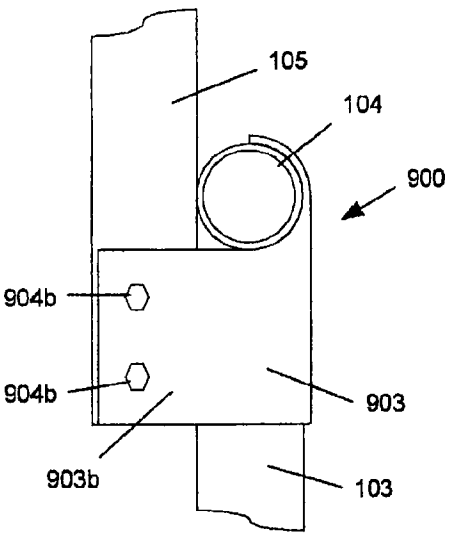
Figure 9B:
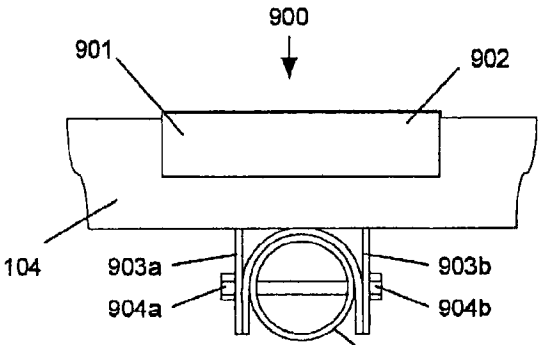
Figure 9A:
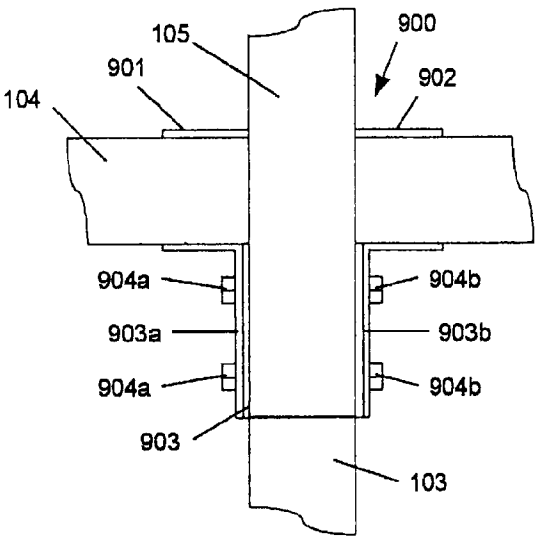
Figure 10:
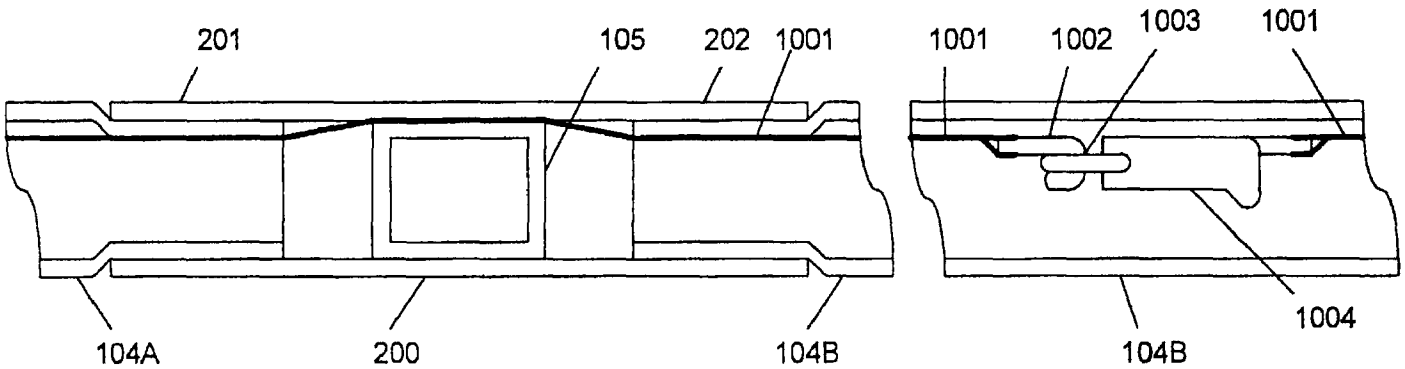
Figure 11:
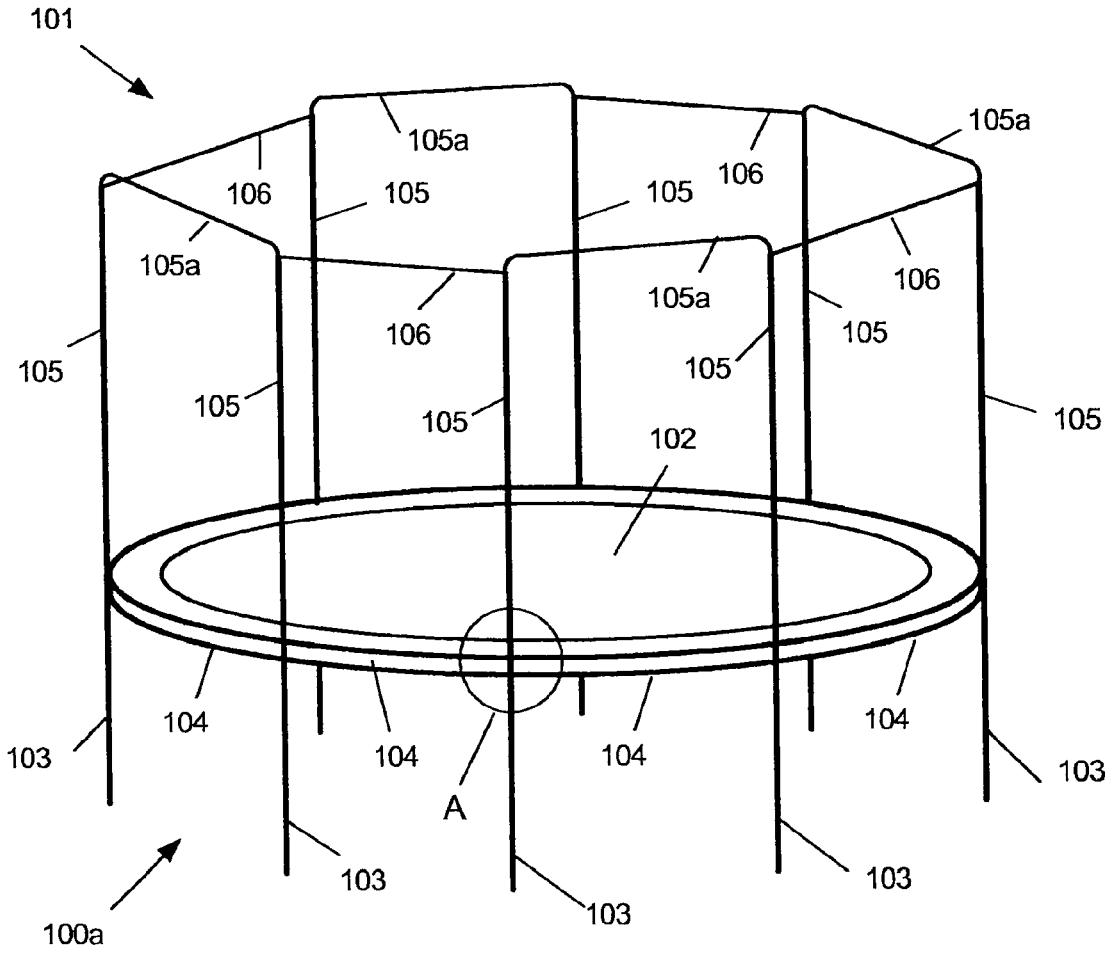

FIGS. 4A-4C respectively show a side view, a top view and an end view of a second exemplary embodiment of a sleeve-joint coupling for a trampoline frame according to the subject matter disclosed herein;

FIGS. 5A-5C respectively show a side view, a top view and an end view of a third exemplary embodiment of a sleeve-joint coupling for a trampoline frame according to the subject matter disclosed herein;

FIGS. 6A-6C respectively show a side view, a top view and an end view of a fourth exemplary embodiment of a sleeve-joint coupling for a trampoline frame according to the subject matter disclosed herein;

FIGS. 7A and 7B respectively show a side view and a top view of a fifth exemplary embodiment of a sleeve-joint coupling for a trampoline frame according to the subject matter disclosed herein;

FIGS. 8A-8C respectively show a side view, a top view and an end view of a sixth exemplary embodiment of a sleeve-joint coupling for a trampoline frame according to the subject matter disclosed herein;

FIGS. 9A-9C respectively show side, top and end views of an exemplary embodiment of a coupling member for a trampoline frame according to the subject matter disclosed herein;

FIG. 10 depicts a top cutaway view of the first exemplary embodiment of a sleeve joint coupling according to the subject matter disclosed herein; and FIG. 11 depicts a perspective view of an exemplary trampoline having an exemplary alternative embodiment of a safety enclosure.

Corresponding reference numerals indicate corresponding parts throughout the several views of the drawings.

DETAILED DESCRIPTION

Example embodiments will now be described more fully with reference to the accompanying drawings.

Figure 1:
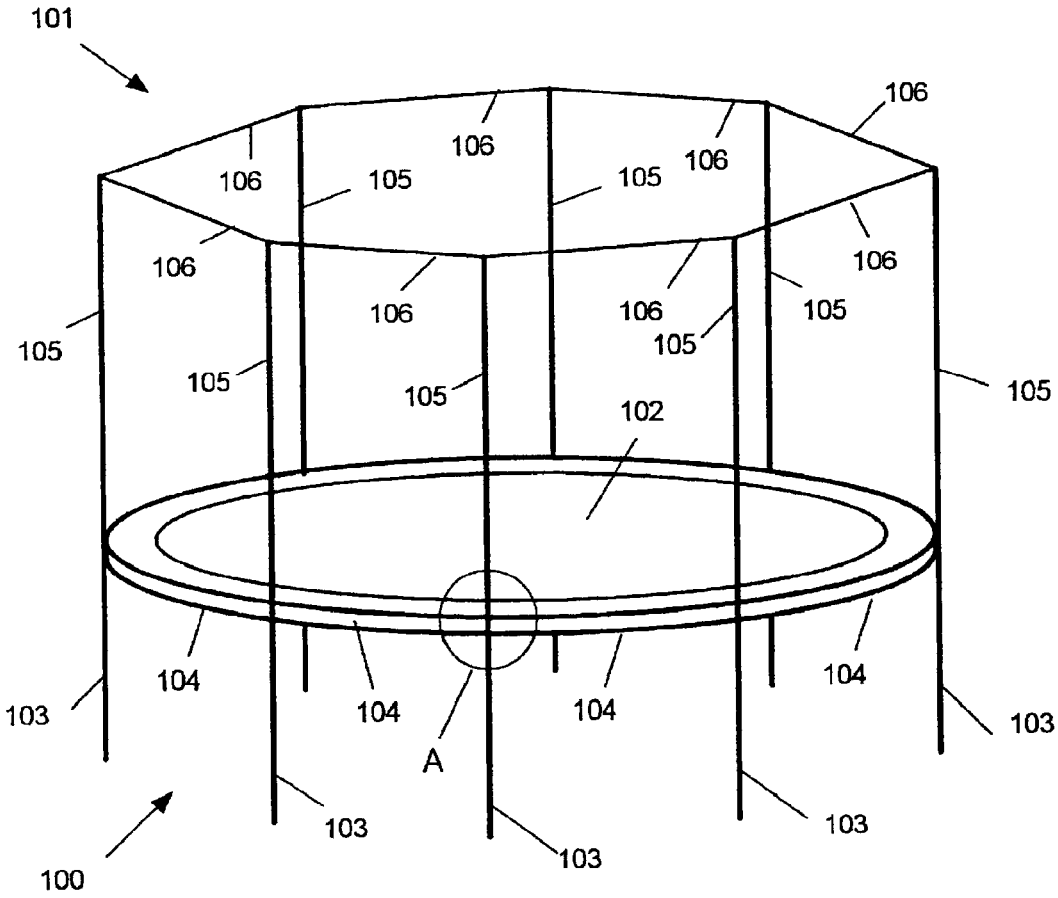

FIG. 1 depicts a perspective view of an exemplary trampoline 100 having an exemplary safety enclosure 101. Trampoline 100 includes a rebounding surface 102 and a frame structure having vertical frame members 103 and a circular frame that can be formed from a plurality of circular frame members 104. Vertical frame members 103 and circular frame members 104 are typically made from hollow metal tubing having sufficient strength to bear the stresses and loads that are associated with trampolines. Safety enclosure 101 includes a frame structure having vertical pole members 105 and horizontal support members 106. A horizontal support member 106 is connected between adjacent vertical pole members in a substantially inflexible manner. A structural member that is suitable for both vertical pole members 105 and horizontal support members 106 is disclosed by U.S. Pat. No. 6,450,187 to Lin et al., which is incorporated by reference herein in its entirety.

Complete details of trampoline 100 and safety enclosure 101 are not shown in FIG. 1 for simplicity. For example, safety enclosure 101 includes a mesh- or netting-type of material that extends between adjacent vertical pole members 105 and between horizontal frame members 106 and circular frame member 104 that together with circular frame 104, vertical pole members 105 and horizontal support members 106 operate as a fence around rebounding surface 102 in order to keep a user on trampoline 100 and reduce the risk of injury to the user.

According to the subject matter disclosed herein, vertical pole members 105 of safety enclosure 101 attach to the frame structure of trampoline 100 using a plurality of sleeve-joint couplings, of which one is indicated at A in FIG. 1. FIGS. 2A-2D and FIG. 3 show details of a first exemplary embodiment of a sleeve-joint coupling according to the subject matter disclosed herein.

Figure 2B:
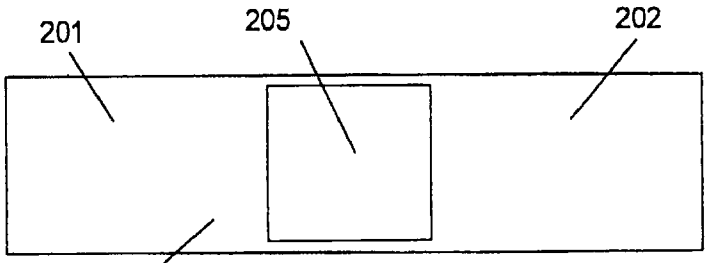
FIG. 2D shows a perspective view of the first exemplary embodiment of a sleeve joint coupling according to the present invention.
Figure 2A:
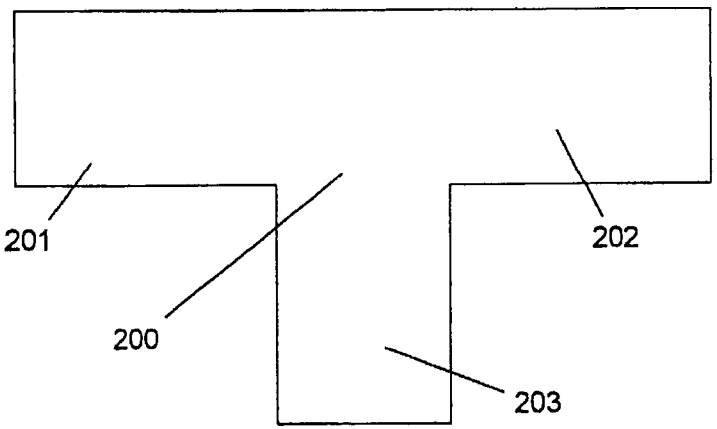
Figure 2C:
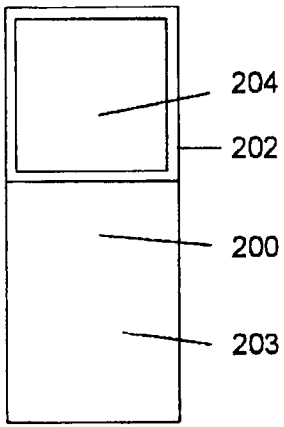
Figure 2D:
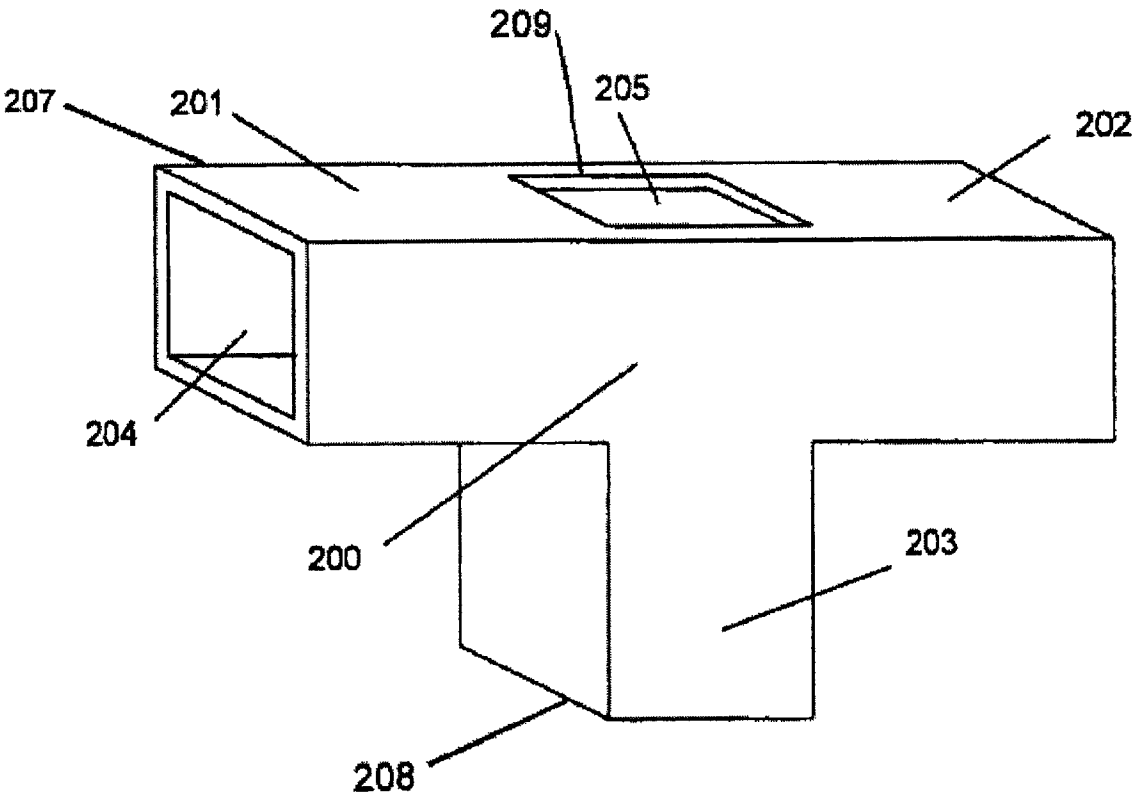

In particular, FIGS. 2A-2C respectively show a side view, a top view and an end view of the first exemplary embodiment of a sleeve-joint coupling 200 for a trampoline frame according to the subject matter disclosed herein. FIG. 2D shows a perspective view of sleeve-joint coupling 200. Sleeve joint coupling 200 is generally shaped as a "T" and includes three arm members 201-203, each having a generally square cross sectional shape. The arm members 201-203 can be integrally connected so that the sleeve joint coupling 200 is a single, monolithic part that does not include separate fasteners. Arm members 201, 202 extend along a substantially common axis in a generally horizontal direction, and arm member 203 extends along a substantially vertical axis that is perpendicular to the common axis of the arm members 201, 202. The arm members 201, 202 each terminate at a planar top surface 207 (FIG. 2D) that extends in the horizontal direction. The arm member 203 terminates at a rectangular bottom surface 208 or rim. Also, sleeve joint coupling 200 includes an opening 205 (aperture), shown in FIG. 2D, which extends through the top surface 207. The opening 205 terminates at a top rim 209 that is substantially flush with the top surface 207.

Each arm member 201-203 receives a trampoline frame member (not shown in FIGS. 2A-2C) of similar cross-sectional shape into an opening 204 (FIGS. 2C and 2D). The opening 205 receives a safety enclosure vertical pole member (not shown in FIGS. 2A-2C) having a generally square cross-sectional member.

Figure 3:
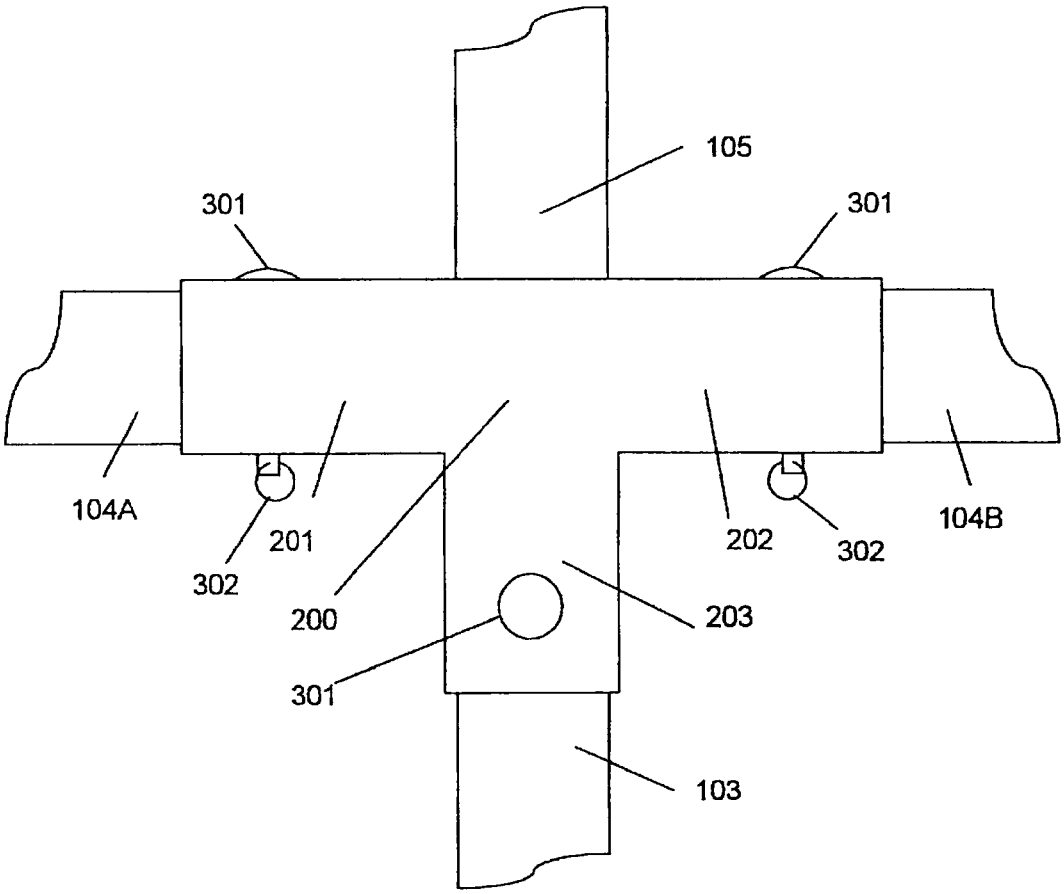
FIG. 3 shows details of a first exemplary embodiment of sleeve-joint coupling according to the subject matter disclosed herein.

FIG. 3 depicts View A, shown in FIG. 1, in greater detail. In FIG. 3, sleeve joint coupling 200 couples circular frame member 104A to circular frame member 104B and to vertical frame member 103. Circular frame members 104A and 104B are secured to sleeve joint coupling 200 using, for example, pins 301 and cotter rings 302 (not shown in FIGS. 2A-2D). Alternatively, circular frame members 104A and 104B can be secured to sleeve-joint coupling 200 using sheet metal screws, and/or bolts and nuts. As yet another alternative, the inner surface of each arm member of sleeve-joint coupling can be threaded to engage complementary threading on each end of a circular frame member 104 and on one end of a vertical frame member 103. Additionally, a threaded connection between sleeve joint coupling 200 and a frame member can be secured using a pin and cotter ring arrangement, a sheet metal screw and/or a bolt and nut.

Vertical pole member 105 of safety enclosure 101 is inserted into opening 205 (FIGS. 2B and 2D) and extends through sleeve-joint coupling 200 into vertical frame member 103 a distance that is sufficient to distribute any shearing and/or torquing forces that may be imparted to vertical pole member 105 along the inside of vertical frame member 103 so that vertical frame member 103 does not fail. Vertical pole member 105 can be secured in vertical frame member 103 using, for example, a pin 301 and a cotter ring (not shown). Alternatively, vertical pole member 105 is secured in vertical frame member 103 using a sheet metal screw and/or a bolt and nut.

Also, it will be appreciated that the trampoline 100 could be used without the safety enclosure 101. As such, the vertical pole member 105 would not be included. Regardless, the sleeve-joint coupling 200 can still securely couple the vertical frame member 103 and the frame members 104A, 104B for use of the trampoline 100 without the safety enclosure 101. Because the top surface 207 (FIG. 2D) of the coupling 200 defines the uppermost surface of the sleeve-joint coupling 200 and because the top rim 209 of the opening 205 is substantially flush with the top surface 207, the sleeve joint coupling 200 can improve safety of the trampoline 100. Specifically, the top surface 207 extends substantially in the horizontal direction such that the top surface 207 is unlikely to trip the user of the trampoline 100 or to otherwise interfere with the user's enjoyment of the trampoline 100.

FIGS. 4A-4C respectively show a side view, a top view and an end view of a second exemplary embodiment of a sleeve-joint coupling 400 for a trampoline frame according to the subject matter disclosed herein. Sleeve-joint coupling 400 is generally shaped as a "T" and includes three arm members 401-403, each having a generally round cross-sectional shape. The arm members 401-403 can be integrally connected so that the sleeve-joint coupling 400 is a single, monolithic part that does not include separate fasteners. Each arm member 401-403 receives a trampoline frame member (not shown in FIGS. 4A-4C) of similar cross-sectional shape into an opening 404 (FIG. 4C). Sleeve joint coupling 400 includes an opening 405, shown in FIG. 4B, that receives a safety enclosure vertical pole member (not shown in FIGS. 4A-4C) having a generally round cross-sectional member. The opening 405 is defined within and substantially flush with the top surface of the arm members 401, 402 as shown in FIG. 4B.

FIGS. 5A-5C respectively show a side view, a top view and an end view of a third exemplary embodiment of a sleeve-joint coupling 500 for a trampoline frame according to the subject matter disclosed herein. Sleeve-joint coupling 500 is generally shaped as a "T" and includes three arm members 501-503, each having a generally oval cross sectional shape. The arm members 501-503 can be integrally connected so that the sleeve-joint coupling 500 is a single, monolithic part that does not include separate fasteners. Each arm member 501-503 receives a trampoline frame member (not shown in FIGS. 5A-5C) of similar cross-sectional shape into an opening 504 (FIG. 5C). Sleeve joint coupling 500 includes an opening 505, shown in FIG. 5B, that receives a safety enclosure vertical pole member (not shown in FIGS. 5A-5C) having a generally oval cross sectional member. As shown in FIG. 5A, the opening 505 is saddle-shaped and extends through the top surface of the arm members 501, 501.

FIGS. 6A-6C respectively show a side view, a top view and an end view of a fourth exemplary embodiment of a sleeve-joint coupling 600 for a trampoline frame according to the subject matter disclosed herein. Sleeve-joint coupling 600 is generally shaped as a "T" and includes three arm members 601-603, each having a generally triangular cross-sectional shape. The arm members 601-603 can be integrally connected so that the sleeve-joint coupling 600 is a single, monolithic part that does not include separate fasteners. Each arm member 601-603 receives a trampoline frame member (not shown in FIGS. 6A-6C) of similar cross-sectional shape into an opening 604 (FIG. 6C). Sleeve joint coupling 600 includes an opening 605, shown in FIG. 6B, that receives a safety enclosure vertical pole member (not shown in FIGS. 6A-6C) having a generally triangular cross-sectional member. The arm members 601, 602 each terminate along a substantially planar top surface, and the opening 605 extends through and is substantially flush with this planar top surface as shown in FIG. 6B.

FIGS. 7A and 7B respectively show a side view and a top view of a fifth exemplary embodiment of a sleeve-joint coupling 700 for a trampoline frame according to the subject matter disclosed herein. Sleeve-joint coupling 700 is generally shaped as an "X" or a "+" and includes four arm members 701-704, each having a generally square cross-sectional shape. Specifically, the arm members 701, 702 can extend generally horizontally, and the arm member 703 can extend vertically downward from the arm members 701, 702, similar to the embodiments discussed above. However, the arm member 704 can extend and protrude upward vertically from the top surface of the arm members 701, 702. The arm members 701-704 can be integrally connected so that the sleeve-joint coupling 700 is a single, monolithic part that does not include separate fasteners. Each arm member 701-704 receives a trampoline frame member (not shown in FIGS. 7A and 7B) of similar cross-sectional shape into an opening 705, of which only one opening 705 is shown (FIG. 7B). Each opening 705 of the arm members 701, 702 can receive a frame member 104, the opening 705 of the arm member 703 can receive a vertical frame member 103, and the opening 705 of the arm member 704 can receive a vertical pole member 105 (none of which are shown in FIGS. 7A and 7B). The frame members 104, vertical frame members 103, and vertical pole members 104 can each have a generally square cross-sectional shape to fit securely within the openings 705. It should be understood that sleeve-joint coupling 700 can have an alternative cross-sectional shape, such as any of the exemplary cross-sectional shapes described herein, and a mating vertical frame member, circular frame member and vertical pole member would have a corresponding cross-sectional shape.

FIGS. 8A-8C respectively show a side view, a top view and an end view of a sixth exemplary embodiment of a sleeve-joint coupling 800 for a trampoline frame according to the subject matter disclosed herein. Sleeve-joint coupling 800 is generally shaped as a "T" and includes three arm members 801-803, each having a generally round cross sectional shape. Sleeve-joint coupling 800 also includes a side sleeve member 804 having an aperture 805, configured as a blind hole, that receives a safety enclosure vertical pole member (not shown in FIGS. 8A-8C) having a generally round cross-sectional member. The arm members 801-803 and the side sleeve member 804 can be integrally connected together so that the sleeve-joint coupling 800 is a single, monolithic part that does not include separate fasteners. Side sleeve member 804 has sufficient length and strength to allow a safety enclosure vertical pole to extend into side sleeve member 804 so that the vertical pole would not come out during use. Each arm member 801-803 receives a trampoline frame member (also not shown in FIGS. 8A-8C) of similar cross-sectional shape into an opening 806 (FIG. 8C). In an alternative embodiment, aperture 805 could be configured to allow a safety enclosure vertical pole to extend through the length of the side sleeve member 804 to the ground or to another device that fastens the vertical pole to the corresponding vertical frame member 103.

It should be understood that openings 806 and aperture 805 can have a cross-sectional shape other than the rounded cross-sectional shape illustrated in FIGS. 8A-8C. For instance, the openings 806 and aperture 805 can have any of the exemplary triangular, ovate, polygonal, and/or rectangular cross-sectional shapes described herein, and a mating vertical frame member, circular frame member and/or vertical pole member can have a corresponding cross-sectional shape.

It should also be understood that, in the vertical direction (vertical axis) defined by the arm member 803, the top rim 809 of the opening 805 in the side sleeve member 804 is disposed between the top surface 807 of the arm members 801, 802 and the bottom surface 808 of the arm member 803. (See FIG. 8A.) In other words, the top rim 809 is disposed below the uppermost surface (i.e., the top surface 807) of the sleeve-joint coupling 800. Accordingly, even if trampoline 100 is used without the enclosure system 101 (i.e., without the safety enclosure vertical pole inserted in the side sleeve member 804), the top surface 807 remains the uppermost surface of the sleeve-joint coupling 800. Thus, the sleeve-joint coupling 800 is unlikely to interfere with the user's enjoyment of the trampoline 100.

FIGS. 9A-9C respectively show side, top and end views of an exemplary embodiment of a coupling member 900 for a trampoline frame according to the subject matter disclosed herein. Coupling member 900 is generally shaped as a "T" and includes three arm members 901-903, each having a cross-sectional shape having a portion that is generally rounded. Each arm member 901 and 902 receives a corresponding circular frame member 104. Arm member 903 receives a corresponding vertical frame member 103. Alternatively, each arm member 901-903 has a cross-sectional shape that matches the cross-sectional shape of the corresponding circular frame member and vertical frame member. Arm 903 of coupling member 900 is also configured with flange members 903*a* and 903*b* that receive a vertical pole member 105 of a safety enclosure. Vertical pole member 105 is held in place between flange members 903*a* and 903*b* with fasteners 904*a* and 904*b*, such as a bolt 904*a* and nut 904*b*, that extend through holes (not shown) in vertical pole member 105. Flange members 903*a* and 903*b* have sufficient length and strength, and fasteners 904*a* and 904*b* have sufficient strength so that vertical pole member 105 remains in place during use. In an alternative embodiment, vertical pole member 105 could extend past flange member 903*a* and 903*b* to the ground or to another device that fastens vertical pole member 105 to the corresponding vertical frame member 103.

FIG. 10 depicts a top cutaway view of the first exemplary embodiment of a sleeve joint coupling 200 according to the subject matter disclosed herein. However, any of the sleeve-joint couplings disclosed herein could be included in the assembly shown in FIG. 10. Two circular frame members 104A and 104B are shown in FIG. 10 respectively engaging arm members 201 and 202 of sleeve-joint coupling 200. A vertical pole member 105 of a safety enclosure is also shown. A frame tension member 1001, such as a strap of webbing, a wire or a cable, is shown threaded through circular frame members 104A and 104B and sleeve-joint coupling 200. Frame tension member 1001 is fastened in a well known manner to a hook assembly 1002 that engages a loop 1003 of a buckle assembly 1004 that is accessible through a hole (not shown) in circular frame member 104A, 104B. Buckle assembly 1004 has two positions: an open position that allows hook assembly 1002 and loop 1003 to be conveniently engaged, and a closed position that places frame tension member 1001 under tension. When frame tension member 1001 is under tension, each sleeve-joint coupling 200 that frame tension member 1001 passes through is urged toward the center of the trampoline frame structure, thereby making the joints of frame structure even more reliable. Alternatively, a plurality of frame tension members can be used to form a line of continuous tension around a trampoline frame instead of a single frame tension member, as depicted in FIG. 10. As yet another alternative, frame tension member 1001 could be attached to the outside of sleeve-joint coupling 200, such as through a loop fastened to the outside of sleeve-joint coupling 200. Still another alternative provides that a turn-buckle arrangement is used for placing tension on frame tension member 1001.

While exemplary trampoline 100 shown in FIG. 1 is depicted as being round, it should be understood that the subject matter disclosed herein could be used with a trampoline and safety enclosure having a different shape, such as square, rectangular or oval. Additionally, the sleeve-joint coupling of the subject matter disclosed herein can be made from any suitable material that has sufficient strength to bear the loads and stresses that are associated with trampolines, such as metals and plastics. Further, while the sleeve-joint coupling of the subject matter disclosed herein has been described in terms of vertical frame members and circular frame members fitting into the sleeve-joint coupling, it should be understood that the sleeve-joint coupling of the subject matter disclosed herein can be configured so that one or all of the arm members of the sleeve-joint coupling fit into vertical frame members and circular frame members of the trampoline frame. Further still, while the sleeve-joint coupling of the subject matter disclosed herein has been described as having several exemplary cross-sectional shapes, it should be understood that a sleeve-joint coupling according to the subject matter disclosed herein could have any cross-sectional shape or have arm members having different cross sectional shapes. As yet another alternative, the sleeve joint coupling of the subject matter disclosed herein could be formed to be part of a vertical frame member. As still another alternative, the sleeve-joint coupling of the subject matter disclosed herein could be configured to substantially form a "T".

While the vertical pole members 105 of safety enclosure 101 has been described as extending into vertical frame members 103, it should be understood that at least one or more vertical pole member 105 of safety enclosure 101 could extend to the ground along the outside of a vertical frame member 103, in which case such a vertical pole member would be attached to the corresponding vertical frame member at a minimum of two places, such as by using a sleeve-joint coupling similar to that shown in FIGS. 8A-8C and, for example, a tiewrap device near the bottom of a vertical frame member 103.

As yet another alternative embodiment, a safety enclosure vertical pole member 105 could be configured to form an arch (105*a* of trampoline 100*a* in FIG. 11), or an arc shape, between two frame members 103. The two frame members 103 could be adjacent or could be separated by one or more other frame members 103. A horizontal support member would then be connected between adjacent peaks of an arch in a substantially inflexible manner.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A trampoline comprising:

a first frame member;

a second frame member;

a third frame member;

a pole member; and a sleeve joint coupling that couples the first, second, and third frame members and the pole member, the sleeve joint coupling including a first arm with a first passage, a second arm with a second passage, a third arm extending away from the second arm and including a third passage, and an aperture that terminates at a top rim, the first passage having a first axis, the second and third passages sharing a substantially common axis, the first axis being substantially perpendicular to the substantially common axis, the first axis extending in a vertical direction, the first frame member being received in the first passage, the second frame member being received in the second passage, the third frame member being received in the third passage, and the pole member formed in the uppermost surface and being received in the aperture to extend away from the first frame member, at least the second and third arms defining an uppermost surface of the sleeve joint coupling, the top rim of the aperture being one of disposed substantially flush with the uppermost surface.

2. The trampoline of claim 1, wherein the aperture defines an aperture axis that is substantially parallel to the first axis.

3. The trampoline of claim 2, wherein the aperture axis is substantially aligned with the first axis.

4. The trampoline of claim 1, wherein at least one of the second and third passages has a cross section taken perpendicular to the substantially common axis, and wherein the cross section has at least one substantially flat side.

5. The trampoline of claim 4, wherein the cross section is polygonal.

6. The trampoline of claim 5, wherein the cross section is substantially rectangular.

7. The trampoline of claim 1, further comprising a safety enclosure that is supported by the pole member.

8. The trampoline of claim 1, further comprising a tension member that is operably coupled to both the second and third frame members and that applies a force between the second and third frame members to compress the second and third frame members toward each other.

9. The trampoline of claim 8, wherein the tension member extends internally through the second frame member, through the third frame members, and through the sleeve joint coupling.

10. The trampoline of claim 1, wherein the first, second, and third arms are integrally connected such that the sleeve joint coupling is a single, monolithic part.

11. The trampoline of claim 1, wherein the substantially common axis is substantially straight.

12. The trampoline of claim 1, wherein at least one of the second and third passages has a cross section taken perpendicular to the substantially common axis, and wherein the cross section is substantially constant along an entire length of the at least one of the second and third passages.

13. The trampoline of claim 1, wherein the uppermost surface of the sleeve joint coupling spans across both of the second and third arms, and the aperture extends through the uppermost surface of the sleeve joint coupling such that the top rim of the aperture is substantially flush with the uppermost surface.

14. A trampoline comprising:

a first frame member;

a second frame member;

a third frame member;

a pole member; and a sleeve joint coupling that couples the first, second, and third frame members and the pole member, the sleeve joint coupling including a first arm with a first passage, a second arm with a second passage, a third arm extending away from the second arm and including a third passage, and an aperture, the first passage having a first axis, the second and third passages sharing a substantially common axis, the first axis being substantially perpendicular to the substantially common axis, the first frame member being received in the first passage, the second frame member being received in the second passage, the third frame member being received in the third passage, and the pole member being received in the aperture to extend away from the first frame member, the first, second, and third arms being integrally connected such that the sleeve joint coupling is a monolithic structure.

15. The trampoline of claim 14, wherein the aperture defines an aperture axis that is substantially parallel to the first axis.

16. The trampoline of claim 15, wherein the aperture axis is substantially aligned with the first axis.

17. The trampoline of claim 14, further comprising a tension member that is operably coupled to both the second and third frame members and that applies a force between the second and third frame members to compress the second and third frame members toward each other.

18. The trampoline of claim 14, wherein the second and third arms cooperate to define an uppermost surface of the sleeve joint coupling, wherein the aperture terminates at a top rim that is disposed substantially flush with the uppermost surface.

* * * * *